US007494454B2

(12) United States Patent
Sheets

(10) Patent No.: US 7,494,454 B2
(45) Date of Patent: Feb. 24, 2009

(54) ABDOMINATOR: ABDOMEN AND OBLIQUES EXERCISE MACHINE

(76) Inventor: Todd Sheets, 23896 Copenhagen St., Mission Viejo, CA (US) 92691

( * ) Notice: Subject to any disclaimer, the term of this patent is extended or adjusted under 35 U.S.C. 154(b) by 64 days.

(21) Appl. No.: 11/436,911

(22) Filed: May 18, 2006

(65) Prior Publication Data

US 2007/0270294 A1 Nov. 22, 2007

(51) Int. Cl.
*A63B 26/00* (2006.01)

(52) U.S. Cl. ..... 482/140; 482/146

(58) Field of Classification Search ..... 482/146–147, 482/34, 79–80, 70–71
See application file for complete search history.

(56) References Cited

U.S. PATENT DOCUMENTS

2004/0245745 A1* 12/2004 Vasser ..... 280/282

* cited by examiner

*Primary Examiner*—Lori Amerson
(74) *Attorney, Agent, or Firm*—Law Office of J Shedd & Associations, P.C.; Jill C. Shedd

(57) ABSTRACT

The present invention describes a specialized exercise apparatus and method for use that targets the muscles in and around the abdominal, oblique muscles and mid section of the body. The machine is comprised of a flat platform upon which an individual stands while grasping a pair of handlebars that are positioned at waist height. The handle bars are attached to the top of a vertical riser that extends downwardly and is attached to a pair of horizontal rotating pivot arms. The pivot arms are attached to the center of a rotating power pulley horizontally suspended by bearings below the forward area of said platform. The power pulley is connected by a belt to a resistance mechanism, such as a flywheel or turbine fan, again suspended by bearings, below the rear portion of said platform. In the flywheel adaptation of this invention, additional resistance is provided by an adjustable magnet that is controlled by a lever mounted to the side of the vertical riser. An individual stands upon the apparatus, and while keeping the lower body relatively stationary, rotates the handle bars, and thus the pivot arms, from side to side up to 220 degrees of rotation and provides an adjustable measure of resistance which produces an increased use of the muscles in and around an individual's torso and midsection area.

13 Claims, 4 Drawing Sheets

ABDOMINATOR: ABDOMEN AND OBLIQUES EXERCISE MACHINE

BACKGROUND OF THE INVENTION

1. Field of Invention

This invention relates generally to an exercise machine and method of use that primarily targets the abdominal and mid-torso muscles of an individual, but also serves to strengthen the entire body as well as provide a cardiovascular/aerobic workout.

2. Background

The inventor, a licensed Chiropractor in the state of California for the past 21 years, has been looking for tools that would allow him to better serve his patients. One of the problems the inventor often encountered were patients that needed to tone and strengthen their torso area so as to alleviate back strain by tightening and strengthening the abdomen, the oblique abdominis muscles, and the erector spinae muscles. However, many of these patients were unable to lie supine on the ground, kneel on the ground, or even sit for very long to perform more traditional torso strengthening exercises using traditional exercise equipment without feeling large amounts of discomfort.

While in the grocery store one day, with a fully laden cart, the inventor swung the cart in an arc while he pivoted at the waist. He immediately noticed how that movement, coupled with resistance, targeted the torso area. He also noticed that although it significantly targeted the torso area, it was a relatively easy movement to make and that by simply standing and rotating one's body with resistance one could effectively work on the muscles in the torso area.

Thus, this invention was originally designed to rid the body of "lovehandles", or oblique muscles and to strengthen the back muscles at the same time. In addition, the machine works the entire body both, strengthening the majority of the muscles and aerobically working the heart muscle.

The primary muscle groups that this invention isotonically targets on the anterior portion of a human body are the a) oblique abdominis muscles ("lovehandles"); b) rectus abdominis Muscles; c) biceps brachii muscles; and the d) pectoralis muscles. The primary muscle groups that this invention isotonically targets on the posterior portion of a human body are the a) erector spinae muscles; b) latissimus dorsi muscles and c) triceps brachii Muscles.

The primary muscle groups that this invention isometrically targets on the anterior portion of the human body are the quadriceps femoris muscles. The primary muscle groups that the invention isometrically targets on the posterior portion of the human body are the a) gluteal muscles (muscles that comprise the buttocks and allow a person to remain in an erect posture); and b) biceps femoris muscles (muscles on the back of the upper leg that enable a leg to bend).

One of most positive aspects of this invention is the possible life extension it may bring by using the machine on a regular basis, especially today with the ballooning of bellies, and the early death from Diabetes and Heart Disease. Recent studies show that there is a direct correlation between a person's waist size and both Heart Disease and Diabetes. This invention not only strengthens all the core muscles needed for good posture and good health, but it aerobically burns calories at a high rate of speed, slimming down your waist size. Only a short period of time on this invention and an individual will feel as if they have had a complete aerobic workout.

The machine can be used by anyone, young or old, in shape or not, male or female. The resistance is only as difficult or easy as an individual desires, and thus it is safe for everyone. An individual does not have to lie supine or kneel. For some people it is very difficult for them to kneel or lie supine due to arthritis, knee injury, obesity, etc. With this invention an individual only has to be able to stand and grasp a handle and rotate clockwise and counterclockwise by keeping the lower body stationary and by rotating the upper body from the pelvic area. In addition, this invention is a tremendous strengthening and stretching device for all athletes, especially golfers, baseball players, tennis players, etc, as this invention strengthens the core muscles in the midsection which are needed for all sports.

3. Description of Related Art

There is a plethora of exercise apparatus and methods of exercising that already exist. The core area of the human body (as defined by the oblique abdominis muscles, the rectus abdominis muscles and the erector spinae muscles) is, however, one area which is difficult for many individuals to exercise to tone muscles and reduce fat.

Many of the exercise apparatuses that exist focus on the strengthening or toning aspects of the core region. The ongoing problem with the existing exercise apparatuses that focus on the core body is twofold. First, as is well known in the health field, the physical fitness field and in the nutrition field an individual cannot "spot reduce" fat from any part of the body and that well know fact is especially true of the core area, or lovehandle area. The only way to reduce fat is to either reduce calorie intake and/or to promote aerobic activity. Most of the extant exercise apparatuses focus solely on strengthening the core muscles and thus do not address the need to reduce fat through aerobic exercise.

For example, U.S. Pat. No. 6,669,610 claims a method and apparatus for exercising internal and external oblique muscles by utilizing lateral forces generated by the feet while maintaining the upper body in a fixed position to facilitate exercise of the oblique muscles. The U.S. Pat. No. 6,669,610 patent targets the oblique muscles but neglects to take an aerobic workout into consideration. The present invention is patently distinct in a number of ways. First, in order to provide an aerobic workout and to further increase the strengthening benefit the present invention has an active resistance mechanism rather than using the passive weight of an individual's own body. Second, the present invention provides varying levels of resistance based on the active resistance mechanism used, and through the use of a variable resistance magnet. Third, in the present invention an individual's lower limbs are optionally stabilized while the upper body does the work—which is very different from other prior art. This means that not only are the abdomen and oblique muscles exercised, but the entire upper body muscles are also exercised as well (such as the biceps, triceps, latissimus dorsi, and pectoralis muscles). Fourth, because the lower limbs are held in a stable position while rotating the upper body the lower limbs and muscles are working and thus a complete aerobic workout is had. Beyond these distinctions there are many other differences that one skilled in the art can easily see by reading the specification below.

Thus, what is desired is a safe, yet effective, aerobic and muscle strengthening apparatus and method of use so that an individual can achieve both an aerobic workout while toning the core muscles of the body.

4. Objects of the Present Invention

Based on the background, long felt need and lack of an apparatus in the related art to address that long felt need, the following objects of the present invention are discussed.

It is an object of the present invention to provide an apparatus that an individual may employ while in an upright standing position to exercise the "core" muscles, as well as providing an aerobic workout, by using a low impact resistance based method.

It is a further object of the present invention to allow an individual to perform exercises used to primarily isolate the oblique abdominis muscles ("lovehandles"), the rectus abdominis muscles, and the erector spinae muscles It is an additional object of the present invention to provide an apparatus that an individual may employ to release vertebral fixations and loosen tight back muscles in a chiropractic fashion by rotating the upper body from the pelvic area while keeping the lower body stationary.

It is another object of the present invention to provide an adjustable height for the handlebars to accommodate different heights of individuals and to allow an individual to achieve a comfortable grasp of the handlebars while exercising.

It is a further object of the present invention to provide an apparatus and method of use that is safe for most every individual, despite most any physical limitation said individual may have, or regardless of the fitness level of any one particular individual.

It is a further object of the present invention to provide a method for adjusting the amount of resistance experienced by an individual while exercising without forcing an individual to stop or change position.

It is an additional object of the present invention to have as few moving parts and minimal wear as possible.

It is a further object of the present invention to provide a means to move the machine with minimal effort and to allow a method of storing the machine while not in use.

These and other objects and advantages of the present invention will be apparent from the following specification and accompanying drawings.

SUMMARY OF THE INVENTION

With the foregoing background in mind, it is the objective of the present invention to create an exercise apparatus and method for use. This exercise apparatus or exercise machine lies horizontally along the floor and is for use in a standing position. An individual, while grasping a pair of handle bars, rotates his or her body from the pelvic area upwards while maintaining a forward stable stance from the pelvic area downwards. This movement, in turn, moves the handlebars from side to side which moves a vertical riser, which moves the pivot arms, with said pivot arms being attached to the resistance mechanism. This action provides significant use of mid and torso muscle groups and helps to exercise the waist, hips, and stomach areas of the body as well as many other major muscles, including the heart.

The present invention provides a machine that an individual stands upon while grasping a pair of handlebars distally mounted to a rigid vertical riser, which pivots from side to side of the machine up to 220 degrees of arc. The present invention further comprises of an attached pulley and flywheel that is rotated in either direction by the attached vertical riser and handlebars and provides dynamic resistances in each direction as an individual moves the handlebars. This resistance increases at the beginning and end of each motion thus creating a bi-directional use of various muscle groups. In addition, the present invention also describes a magnetic brake, which may be adjusted to vary the constant amount of resistance experienced by an individual. The variable resistance can be adjusted from a lever mounted just below the handlebars while exercising to increase or decrease the level of effort needed to suit an individual's preferences.

In an alternate embodiment the resistance mechanism is a turbine fan. As an individual speeds up his or her rotational motion, the turbine fan turns faster thus generating more air resistance. It is anticipated that the turbine fan resistance mechanism will be lighter in weight than the flywheel resistance mechanism, and thus more suitable for home use.

DETAILED DESCRIPTION OF THE PREFERRED EMBODIMENT

Figure 1:
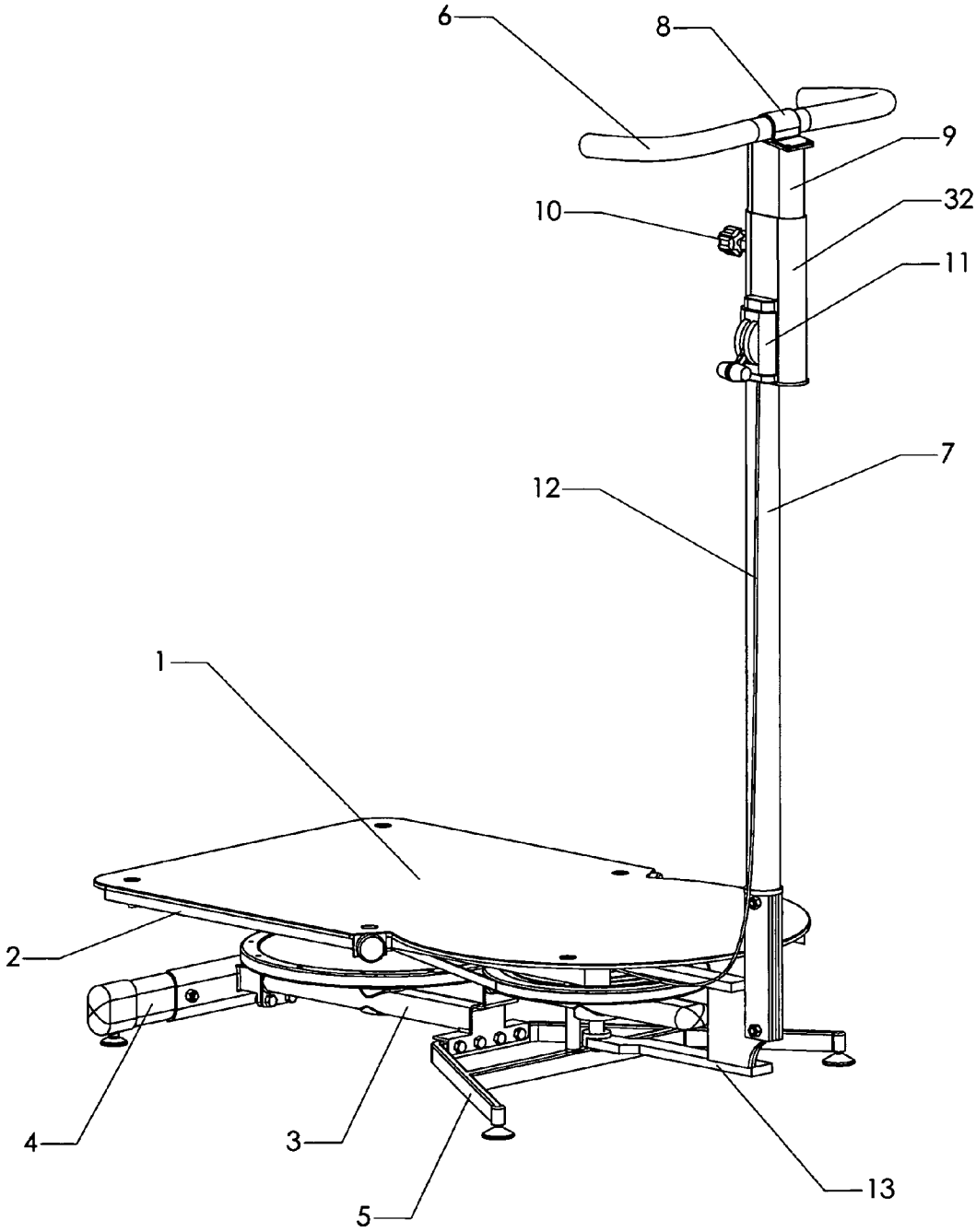
FIG. 1 is an isometric perspective view of the preferred embodiment depicting many of the major components of the present invention.

The terminology used herein should be interpreted in its broadest reasonable manner, even though it is being utilized in conjunction with a detailed description of a certain specific preferred embodiment of the present invention. This is further emphasized below with respect to some particular terms used herein. Any terminology that the reader should interpret in any restricted manner will be overtly and specifically defined as such in this specification. The preferred embodiment of the present invention will now be described with reference to the accompanying drawings, wherein like reference characters designate like or similar parts throughout.

The present invention will be described by way of two major sub-parts. The first of these sub-parts is the skeleton or frame of the invention and is comprised of non-moving components. The second sub-part is comprised of the moving components. Each of these sub-parts will now be discussed in detail.

1. Non-Moving Components of the Present Invention

Figure 2:
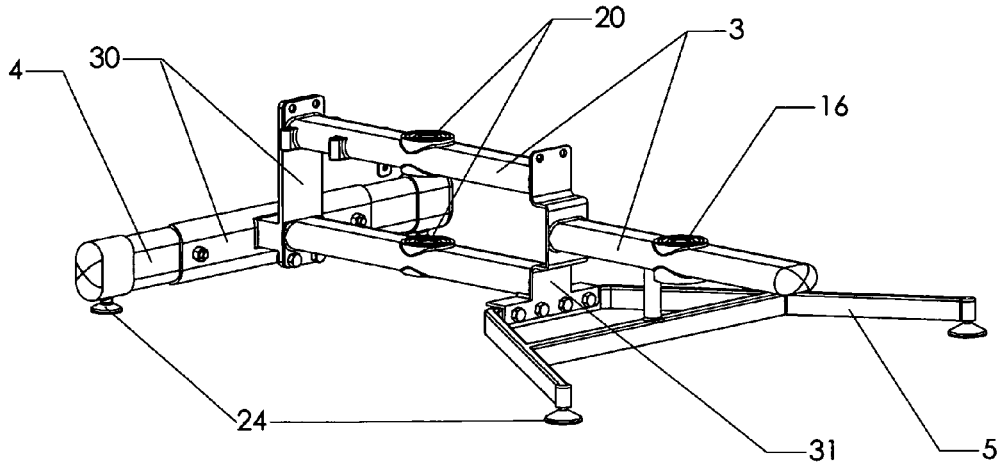
FIG. 2 is a component reduced isometric perspective close up view of the preferred embodiment depicting the main chassis, the front and rear support stand and the foot stands.
Figure 3:
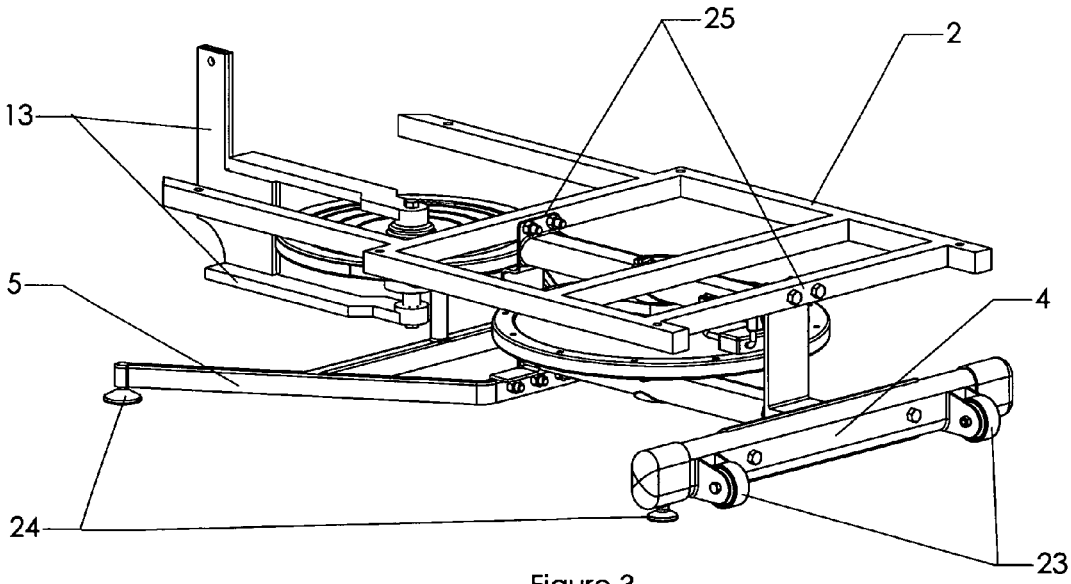
FIG. 3 is an isometric perspective view from the rear of the preferred embodiment depicting the sub-frame, support stands and general mechanics of the present invention.

The primary static non-moving components of the present invention will now be described in detail and will form the primary structure upon which the preferred embodiment is based. With reference to FIGS. 1, 2 and 3 the non-moving components of the present invention and preferred embodiment are generally described as being comprised of a flat platform 1, sub-frame 2, main chassis 3 and support stands 4 & 5 with standoff feet 24.

a. Platform and Sub-Frame

With continued reference to FIG. 1 an exercise machine constructed in accordance with the teachings of the preferred embodiment of the present invention is generally identified with reference to a device comprising of a platform 1 generally made of a highly durable material such as steel plate or other structurally stiff thin flat material. Platform 1 provides a flat area upon which an individual stands while using the device to exercise. Additionally, platform 1 also consists of a non-slip surface comprised of a corrugated texture or coating suitable to prevent an individual's feet from moving while standing on the platform 1 and exerting significant twisting and turning of their body.

With continued reference to FIG. 1 and additional reference to FIG. 3 the preferred embodiment of the present invention is further identified with reference to a device comprising of a platform 1 firmly attached to a rigid sub-frame 2 made of square steel tubing or other structurally suitable material and attached by countersink screws threaded through the surface of platform 1 and sub-frame 2 and secured with the appropriate hardware, such as lock washers and nuts, from the underside of the sub-frame 2. The sub-frame 2 provides a rigid sub-structure for the platform 1 as well as anchor points 25 for attachment to the main chassis 3.

b. Main Chassis and Support Stands

With reference to FIG. 2 the preferred embodiment of the present invention is further shown to be comprised of a main chassis 3 constructed from extruded steel forms or other structurally suitable materials and welded or secured with other structurally suitable fasteners. The main chassis 3 comprises of two horizontal rear support structures each attached to the chassis support end plate 30 at the rear and a common chassis mid-section plate 31. A third forward facing support structure of the main chassis 3 is then attached to the chassis mid-section plate 31 and extends further towards the front.

The main chassis 3 provides the core skeleton structure of the preferred embodiment to which all components are ultimately attached. The main chassis 3 is further identified as being attached to a horizontal rear support stand 4 and a front support stand 5. Both the rear support stand 4 and a front support stand 5 further comprise of stand off feet 24 that are used to support the front and rear of the present invention while protecting the surface upon which the exercise apparatus rest from marring or scuffing and further provides an anti-slip mechanism for keeping the apparatus firmly affixed to said surface.

With reference to FIG. 2 and additional reference to FIG. 3 the horizontal rear support stand 4 is attached with nuts and bolts to the main chassis 3 at the chassis support end plate 30. The horizontal front support stand 5 is attached with nuts and bolts to the main chassis 3 at the chassis mid-section plate 31.

With reference to FIG. 3 the horizontal rear support stand 4 is further comprised of two caster wheels 23 each mounted to the rear side of the horizontal rear support stand 4 and are located such that they are only in contact with the ground when the present invention is tilted upward from the front. When the apparatus is tilted upward from the front and the caster wheels 23 come in contact with the ground and an individual can then easily move the apparatus and/or store the apparatus in a vertical, upright position.

The platform 1, sub-frame 2, horizontal rear support stand 4 and front support stand 5 when attached to the primary structure of the main chassis 3 for the present invention are considered the main non-moving structures of the preferred embodiment.

2. Moving Components of the Present Invention

Figure 4:
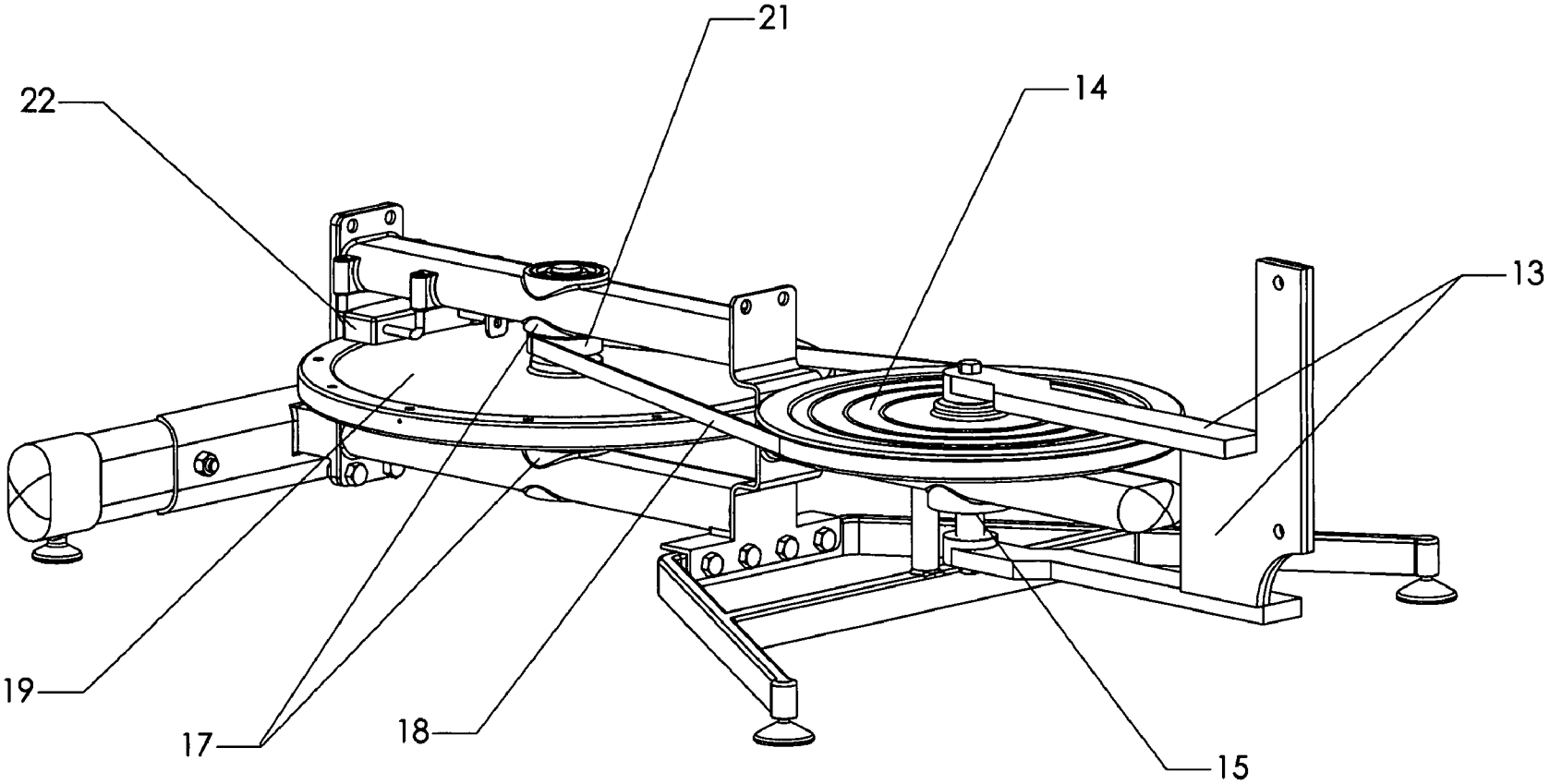
FIG. 4 is a component reduced isometric perspective view of the preferred embodiment depicting, among other things, the pivot arms, the power pulley and the flywheel.

The moving components of the present invention will now be described in detail and will form the primary mechanisms which define the preferred embodiment's functionality. With reference to FIGS. 1, 3 and 4 the moving components of the present invention and preferred embodiment are generally described as being comprised of a handlebar 6, vertical riser 7, horizontal pivot arms 13, power pulley 14, flywheel 19 and adjustable resistance magnet 22.

a. Handlebars, Vertical Riser and Horizontal Pivot Arms

With reference to FIG. 1 the preferred embodiment of the present invention is further shown to be comprised of a handlebar 6 formed in a U-shape and mounted to a vertical adjuster 9 with a mounting clamp 8. The vertical adjuster is further shown to be held in a handlebar adjustment tube 32 located at the top of a vertical riser 7. In the present invention the handlebar 6 is affixed to the top of a vertical adjuster 9 using a U-shaped mounting clamp 8 and held in place with four bolts and locking nuts at each corner of said U-shaped mounting clamp 8.

With continued reference to FIG. 1 and FIG. 2 the handlebars 6 are adjustable in the vertical direction by moving the vertical adjuster 9 within the handlebar adjustment tube 32 of the vertical riser 7. The vertical adjuster 9 is locked into position by an adjuster locking hand wheel 10 located near the top rear of the vertical riser 7. The vertical adjuster 9 and adjuster locking hand wheel 10 allows an individual to set the handle bars 6 to a comfortable height.

With reference to FIG. 1 and additional references to FIG. 3 and FIG. 4 the preferred embodiment of the present invention is further shown to be comprised of a vertical riser 7 attached at the bottom to an upper and lower horizontal pivot arms 13. The present invention and preferred embodiment further shows the vertical riser 7 attached to the pivot arms 13 using two nuts and bolts located and arranged through the frontward vertical member of the pivot arms 13.

Figure 5:
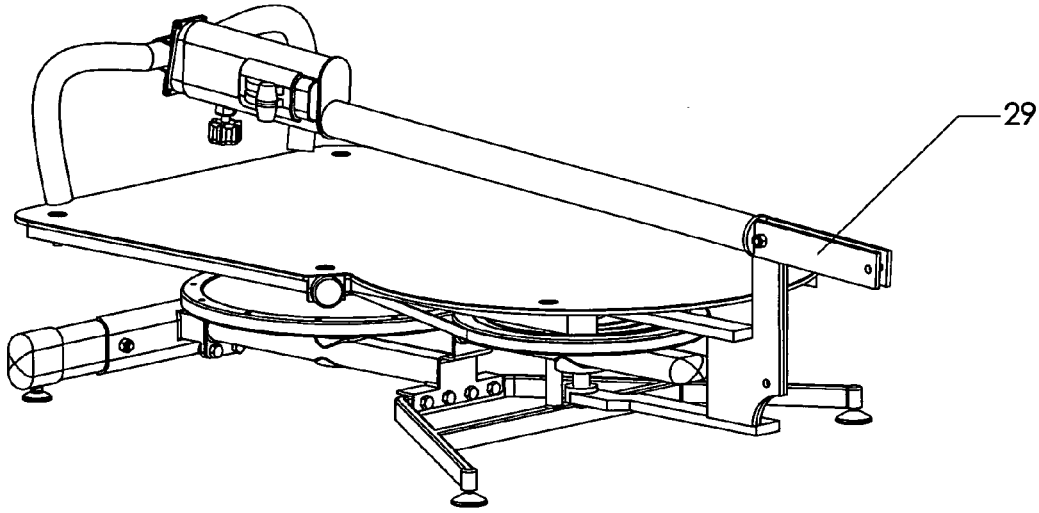
FIG. 5 is an isometric perspective view depicting the preferred embodiment in a folded configuration suitable for storage.

With reference to FIG. 5 the preferred embodiment of the present invention is further shown wherein the lower nut and bolt may be temporarily removed from the pivot arms 13 and vertical riser 7 to allow the vertical riser 7 to be tilted back and lowered such that the handlebars may be rested on the rearward portion of the platform 1. In this configuration an individual may use the protruding lower end 27 of the vertical riser 7 to grasp and lift the front of the present invention such that it may be rolled on the rear caster wheels 23 to a new location or placed in a vertical upright position resting on the back edge of the platform 1 and the rear caster wheels 23 for vertical storage.

b. Power-Pulley and Horizontal Pivot Arms

With reference to FIG. 4 and additional reference to FIGS. 1, 2 and 3 the present invention is further shown to be comprised of pivot arms 13 attached at the ends of the vertical axles of a power pulley 14. The horizontal upper and lower members of the pivot arms 13 are keyed and mated to the ends of the power pulley 14 axle and are held in place by bolts threaded into the center of the power pulley 14 axle.

It is further shown that the power pulley 14 is itself held in place by its lower axle, which is pressed into a power pulley bearing 15. The power pulley bearing 15 is further held in the forward facing support structure of the main chassis 3 by a forward bearing housing 16. The power pulley 14 is free to rotate on its lower axle via the power pulley bearing 15 in either direction driven by the attached horizontal upper and lower members of the pivot arms 13.

With the attached handlebars 6 and vertical riser 7 connected to the forward vertical member of the pivot arms 13 attached to the power pulley 14, the power pulley 14 is driven in either direction of travel from a first forward center position to either side with up to approximately 220 degree of total horizontal arc travel. As an individual moves the handlebars 6 from side to side the power pulley 14 is rotated in the like directions by the attached pivot arms 13.

c. Flywheel and Power Pulley

With continued reference to FIG. 2 and FIG. 4 the preferred embodiment of the present invention further shows a flywheel 19 comprised of a heavy solid circular disc with a center axle and flywheel pulley 21 located on the top side of the flywheel 19. The flywheel 19 is driven by a drive belt 18 attached between the flywheel pulley 21 and the power pulley 14. The flywheel 19 is held in place by its upper and lower axles which are further held by flywheel bearings 20. The flywheel bearings 20 are further held by the rear members of the main chassis 3 rear bearing housings 17. The flywheel 19 is free to rotate about its upper and lower axles within the flywheel bearings 20.

With continued reference to FIG. 4 the preferred embodiment of the present invention further shows that the flywheel 19 is driven by the power pulley 14 by an attached drive belt 18. The drive belt 18 is fitted to the power pulley 14 and flywheel pulley 21 and drives the flywheel 19 in the same direction as the power pulley 14 when rotated by the attached upper and lower horizontal pivot arms 13.

In the preferred embodiment, the power pulley 14 is connected to the flywheel 19 with an eight to one induction ratio to create a degree of dynamic starting and ending rotational resistances. The flywheel 19 provides a measured amount of inertia induced resistance created each time the direction of the power pulley 14 is reversed given an individual more effort the further they move the handlebars 6 and vertical riser 7 from side to side.

d. Alternate Embodiment Using a Turbine Fan and Power-Pulley

Figure 6:
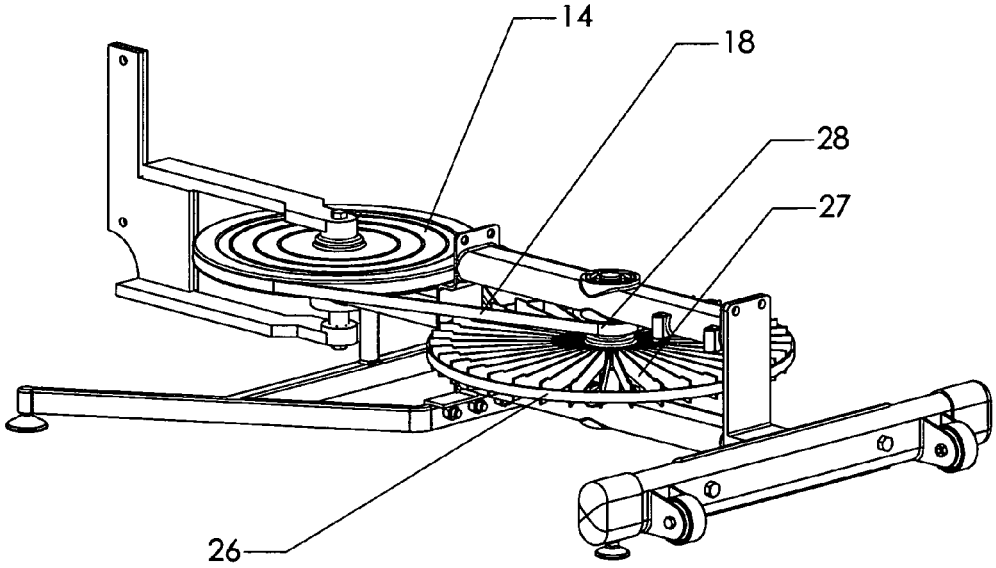
FIG. 6 is a component reduced isometric perspective close up view of an alternative embodiment depicting the installation of a turbine fan replacing the flywheel used in the preferred embodiment.

With reference to FIG. 6 an alternate embodiment of the present invention is shown to use a turbine fan 26, as an alternative to a flywheel 19 as shown in FIG. 4. In this alternate embodiment the turbine fan 26 is comprised of a light weight circular disc with fan blades 27 radiating from the center axle and turbine fan pulley 28 located on the top side of the wheel. The turbine fan 26 is driven by a rubber drive belt 18 attached between the turbine fan pulley 28 and the power pulley 14. The turbine fan 26 is held in place by its upper and lower axles which are pressed into bearings 20 as shown in FIG. 2. The bearings 20 are further held by the rear members of the main chassis 3 rear bearing housings 17. The turbine fan 26 is free to rotate about its upper and lower axles within the bearings 20.

In this alternate embodiment the drive belt 18 is fitted to the power pulley 14 and turbine fan pulley 28 and drives the turbine fan 26 in the same direction as the power pulley 14 when rotated by the attached upper and lower horizontal pivot arms 13. In addition, in this incarnation of the present invention the power pulley 14 is connected to the turbine fan 26 with eight to one induction ratio pulleys to create a degree of dynamic rotational resistances. The turbine fan 26 provides an increased amount of induced resistance the faster an individual moves the handlebars 6 from side to side due to the air resistance generated by the increase in speed of the turbine fan. This creates a reactive induced resistance at the beginning and end of each repetition.

e. Adjustable Resistance Magnet

With reference to FIG. 1 and additional reference to FIG. 4 the preferred embodiment of the present invention is further identified with reference to a device comprising of an adjustable resistance mechanism. The adjustable resistance mechanism is comprised of a resistance lever 11, resistance control cable 12 and a resistance magnet 22. The present invention further shows that the resistance lever 11 is located and mounted to the side of the vertical riser 7 and is connected to the resistance magnet 22 by a control cable 12. When the resistance lever 11 is moved up and down on the side of the handlebar adjustment tube 32, the control cable 12 moves the resistance magnetic 22 from a first closer to a second further distance from the top surface of the flywheel 19.

With continued reference to FIG. 2 and FIG. 4 in the present invention, the resistance magnet 22 position is adjusted remotely by the control cable 12 connected to the resistance lever 11 and provides an adjustable amount of continuous resistance to the flywheel 19. This allows an individual to adjust the amount of magnetically induced resistance and thus increase or decrease the amount of effort needed to move the handlebars 6 and vertical riser 7 from side to side. The adjustable resistance allows an individual to increase and decrease the amount of overall constant resistance experienced while exercising.

The foregoing description details certain preferred embodiments of the present invention and describes the best mode contemplated. It will be appreciated, however, that no matter how detailed the foregoing description appears, the invention can be practiced in many ways without departing from the spirit of the invention. Therefore, the description contained in this specification is to be considered exemplary, rather than limiting, and the true scope of the invention is only limited by the following claims and any equivalents thereof.

What is claimed is:

1. An exercise apparatus for exercising the rectus abdominis muscles, oblique abdominis muscles and erector spinae muscles, while providing an aerobic workout, allowing an individual to stand upright on the exercise apparatus, the exercise apparatus comprising:

a. a handlebar farther comprising a first handle extending outwardly and horizontally from a center point to receive the right hand of an individual using the exercise apparatus and a second handle extending outwardly and horizontally from the opposite side of said center point to receive the left hand of an individual using said exercise apparatus whereby said handlebar is positionable in front of an individual and configured to be held by each of an individual's hands;

b. an adjustable vertical riser connected distally to said horizontal handlebar center point and such adjustable vertical riser extends downwardly there from and is capable of being adjustably positioned vertically so that said handlebars are at a height relative to an individual's grasp;

c. a standing platform for an individual's stationary stance for grasping said handlebars d. a resistance mechanism;

e. pivot arms affixedly attached at their anterior end to said vertical riser and at their posterior end to said resistance mechanism, said pivot arms being capable of being rotated, and hence rotating said vertical riser, in an arc of at least 220 degrees;

f. a main chassis that supports the resistance mechanism and the standing platform;

g. a lateral rear stand affixedly attached to the posterior portion of said main chassis and having sufficient height to provide both ground clearance and stability to the posterior portion of said main chassis;

h. a lateral front stand affixedly attached to the mid section of said main chassis and extending forward having an equal sufficient height as said rear stand to provide both ground clearance and stability to the anterior portion of said main chassis;

i. and fasteners for attaching said standing platform to said main chassis.

2. A resistance mechanism of claim 1 further comprising:
a. a power pulley comprising a solid disc affixedly attached to the anterior portion of said main chassis with an axle held in bearings;
b. a dynamic resistance mechanism capable of providing a range of resistance with a central pulley attached to the posterior portion of said main chassis with axles held in bearings;
c. a drive belt comprising a outer and inner surface and firstly affixed to the power pulley and secondly affixed to the central pulley of said dynamic resistance mechanism;
d. whereby said power pulley activates said drive belt;
e. whereby said drive belt, with an induction ratio, rotates said dynamic resistance mechanism to create a degree of induced dynamic starting and ending resistance;
f. whereby said power pulley is affixedly attached to and driven by said pivot arms.

3. A dynamic resistance mechanism of claim 2 further comprising a heavy flywheel with a center axle and central pulley and a device to control and adjust variable resistance.

4. A dynamic resistance mechanism of claim 2 further comprising a turbine fan capable of generating variable degrees of resistance depending on the speed of rotation of the turbine fan by being comprised of a wheel like structure with blades affixed to the inside diameter, said blades being capable of creating air induced resistance.

5. A device to control and adjust variable resistance of claim 3 further comprising:
a. a resistance control cable;
b. a resistance lever that operatively acts upon said resistance control cable to push or pull the resistance cable by moving said resistance lever from a first upward position to a second downward position;
c. a resistance magnet which is operatively acted upon by the resistance cable and moves from a first closer to a second further distance from the top surface of said flywheel;
d. whereby said device to control and adjust resistance provides an adjustable amount of continuous resistance to the flywheel thereby allowing an individual to adjust the amount of induced resistance 6. A standing platform of claim 1 further comprising:
a. said standing platform having sufficient flat horizontal surface area to allow a user to stand on said standing platform;
b. said standing platform having sufficient flat, horizontal surface area to completely cover the working mechanisms of the apparatus;
c. said standing platform being made from a durable, weather and wear resistant material;
d. said standing platform having an anti-slip surface.

7. A standing platform of claim 1 further comprising:
a. a rigid sub-frame comprised of strong industrial tubing;
b. said rigid sub-frame being suitably attached to said standing platform;
c. whereby said sub-frame provides a rigid sub-structure for the platform as well as anchor points for attachment to the main chassis.

8. An adjustable vertical riser of claim 1 further comprising:
a. an adjustable handlebar riser;
b. a handlebar adjustment tube;
c. a locking means for securing said adjustable vertical riser at a desired position;
d. said adjustable handlebar riser moves to position the handlebars at a comfortable height for each individual;
e. said adjustable handlebar riser position by sliding said adjustable handlebar riser upwards or downwards through said handlebar adjustment tube;
f. whereby said adjustable handlebar riser is secured inside said handlebar adjustment tube by employment of said locking means.

9. A locking means of claim 8 further comprising
a. an adjustable locking knob;
b. an adjustable locking knob post;
c. whereby said adjustable locking knob turns clockwise to position the locking knob post securely up against the adjustable vertical riser to hold it firmly in position.

10. An exercise apparatus of claim 1 further comprising
a. said rear support stand and said front support stand having stand off feet attaching to the obverse side of each support stand;
b. said stand off feed support the front and rear of said exercise apparatus;
c. said stand off feet protect the surface upon which said exercise apparatus rests from marring or scuffing;
d. whereby said stand off feet provide an anti-slip mechanism for keeping the apparatus firmly affixed to said surface.

11. An exercise apparatus of claim 1 further comprising:
a. two wheels mounting to the rear side of the horizontal rear support stand;
b. said wheels affixing to the rear side of the horizontal rear support such that said wheels only contact with the ground or surface when said exercise apparatus is tilted upward from the front;
c. whereby when said apparatus tilts upward from the front said wheels come in contact with the ground or surface.

12. A method of folding and storing the exercise apparatus of claim 1 or claim 11 comprising the acts of:
a. unlatching the vertical riser at the base and pivoting the vertical riser downward and inward from its vertical position;
b. tilting the vertical riser downward and inward such that the handlebars rest on the rearward portion of the standing platform;
c. the lower end of the vertical riser acting as a handle to maneuver said exercise apparatus;
d. tilting the apparatus upward onto the wheels and the wheels come in contact with the ground;
e. whereby said exercise apparatus is then capable of being moved into either a horizontal or vertical storage position.

13. A method of using an exercise machine of claim 1 suitable for exercising the abdominal or core muscles, while providing an aerobic workout, comprising the acts of:
a. mounting said standing platform;
b. grasping the terminal ends of said handlebar mechanism;
c. keeping the lower body relatively stationary;
d. grasping said handlebars while standing on the exercise apparatus and rotating the upper portion of the body, upward from the pelvic area, up to 220 degrees of arc for a period of time;
e. while using inertia and/or said resistance mechanism and thereby generating a variable amount of resistance.

* * * * *